US006293776B1

(12) United States Patent
Hahn et al.

(10) Patent No.: US 6,293,776 B1
(45) Date of Patent: Sep. 25, 2001

(54) METHOD OF CONNECTING AN ECONOMIZER TUBE

(75) Inventors: Greg Hahn; Zili Sun; Carlos Zamudio, all of Arkadelphia; Jason Hugenroth, Hope; Thomas Barito, Arkadelphia, all of AR (US); James W. Bush, Skaneateles, NY (US); Joe T. Hill; John R. Williams, both of Bristol, VA (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/614,398

(22) Filed: Jul. 12, 2000

(51) Int. Cl.[7] ..... F01C 1/02

(52) U.S. Cl. ..... 418/55.6; 418/55.5; 418/55.4; 418/57; 418/97

(58) Field of Search ..... 418/55.6, 97, 55.5, 418/55.4, 57

(56) References Cited

U.S. PATENT DOCUMENTS 6,042,344 * 3/2000 Lifson ..... 417/310
6,142,753 * 11/2000 Bush et al. ..... 418/55.1
6,162,033 * 12/2000 Moore, Jr. et al. ..... 418/55.1

FOREIGN PATENT DOCUMENTS 58-170879-A * 10/1983 (JP) ..... 418/97
02-245490-A * 10/1990 (JP) ..... 418/97
03-043691-A * 2/1991 (JP) ..... 418/97
03-092592-A * 4/1991 (JP) ..... 417/292
04-203381-A * 7/1992 (JP) ..... 418/97

* cited by examiner

*Primary Examiner*—Thomas Denion
*Assistant Examiner*—Theresa Trieu
(74) *Attorney, Agent, or Firm*—Carlson, Gaskey & Olds

(57) ABSTRACT

Scroll compressors having a non-orbiting scroll the type that moves axially for a limited distance are provided with an economizer fluid tube. The economizer tube is received within an opening in the non-orbiting scroll such that the non-orbiting scroll can move relative to the tube. This is an improvement over the prior art, and provides a more secure and simple connection.

16 Claims, 3 Drawing Sheets

METHOD OF CONNECTING AN ECONOMIZER TUBE

BACKGROUND OF THE INVENTION

This invention relates to supplying an economizer fluid to an axially moveable non-orbiting scroll member.

Scroll compressors are becoming widely utilized in refrigerant compression applications. In a standard scroll compressor, a first scroll member has a base and a generally spiral wrap extending from the base. A second scroll member has a base and a generally spiral wrap that interfits with the base of the first scroll member. The second scroll member is driven to orbit relative to the first scroll. Compression occurs as refrigerant is sealingly entrapped between the wraps of the two scroll members as the second scroll member orbits relative to the first. Since scroll compressors have a greater efficiency than many types of compressors, they are desirable for many applications. However, scroll compressors also present design challenges.

One challenge faced by the designers of scroll compressors is that the scroll members must stay in contact with one another for the compression chamber to maintain a seal. However, as the refrigerant is compressed, a force is treated from the compressed refrigerant tending to force the two scroll members away from each other, thus reducing the efficiency of the seal. Scroll designers have addressed this separating force by tapping a compressed refrigerant behind one of the two scroll members to bias it towards the other, resisting the separating force and maintaining the seal. In one type of scroll compressor the tapped refrigerant is tapped to a chamber behind the orbiting scroll. In such compressors the non-orbiting scroll is typically fixed. In a second type of scroll compressor the tapped refrigerant is tapped to a chamber behind the non-orbiting scroll. In this type of s compressor the non-orbiting scroll is permitted to move axially, or float. A seal defines the chamber, and separates a discharge and suction pressure chamber.

Economizer cycles are known in refrigerant cycles. Essentially, an economizer cycle pre-cools a main refrigerant flow leaving a condenser and moving towards a primary expansion valve. To cool the main refrigerant flow, a smaller amount of refrigerant is tapped from the main flow and passed through an economizer heat exchanger. The main refrigerant flow is also passed through the economizer heat exchange where it is cooled by the tapped flow. The tapped refrigerant must be returned to the compressor.

In scroll compressors, it is preferred that the tapped refrigerant be returned to the compressor through the non-orbiting scroll. However, this has proven difficult in scroll compressors with a floating non-orbiting scroll, since the economizer injection port must extend through the floating non-orbiting scroll. The prior art has utilized a ribbed flexible connector that flexes during movement of the non-orbiting scroll. This flexible connector is fixed to the non-orbiting scroll, and to the housing. The rigid connection, and the use of the flexible connector is somewhat complex and expensive. Moreover, a rigid connection is somewhat unreliable in that it is subject to fracture with the relative movement.

SUMMARY OF THE INVENTION

In a disclosed embodiment of this invention, the supply of the economizer fluid extends through a rigid tube rigidly secured within the compressor housing. The tube is secured to the non-orbiting scroll in such a way that the non-orbiting scroll may move relative to the tube. In one embodiment, the tube extends into a seal which defines the back pressure chamber. The tube then selectively delivers economizer fluid through the seal when an economizer cycle is being utilized.

In other embodiments, the economizer tube extends through the housing and into the non-orbiting scroll. The non-orbiting scroll may move relative to the tube in these embodiments. In one embodiment, the economizer tube enters the housing and moves into the non-orbiting scroll through the top. In another embodiment, the tube moves into the bottom of the non-orbiting scroll.

These embodiments provide a much simpler and more reliable connection than has been developed in the prior art.

DETAILED DESCRIPTION OF THE PREFERRED EMBODIMENT

Figure 1:
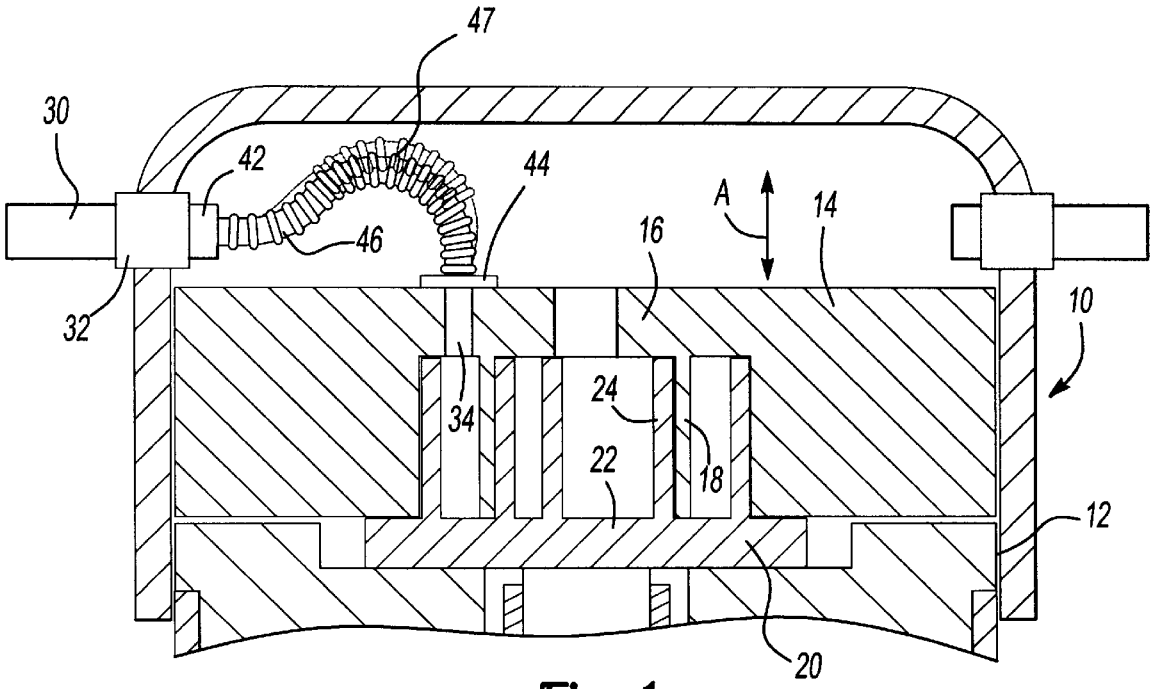
Fig-1 PRIOR ART
FIG. 1 is a schematic view of a prior art flexible connecting system.

A portion of a prior art scroll compressor 10 is schematically and generally shown in FIG. 1. Scroll compressor 10 is generally housed in scroll shell 12. A non-orbiting scroll member 14 is received within scroll shell 12 and is of the type that is permitted to move through a limited axial distance as indicated by arrow A. Non-orbiting scroll member 14 has a base 16 and a wrap 18. An orbiting scroll 20 has base 22 and wrap 24 which interfits with wrap 18 to define compression chambers.

An outside economizer tube 30 introduces refrigerant fluid to scroll 10 by way of economizer injection port 32 in scroll shell 12. Axially moving non-orbiting scroll 14 is provided with an economizer injection port 34 in its base 16. Refrigerant is directed from port 32 to port 34 in the non-orbiting scroll 14 by way of flexible connector tube 40.

Flexible connector tube 40 is provided with receiving portion 42 and outlet portion 44 which are generally unflexed. Receiving portion 42 communicates with economizer injection port 32 to receive refrigerant from outside economizer tube 30. Outlet portion 44 leads into fixed port 34 on the base 16 of non-orbiting scroll member 14. Receiving portion 42 of flexible connecting tube 40 flows to outlet portion 44 by way of U-shaped segment 46 that is generally flexed. Flexible connector tube 40 is designed to allow desired flexibility, such as shown in phantom at 47, so that non-orbiting scroll 14 is permitted to move axially while at the same time, refrigerant from outside economizer tube 30 may be directed into the base of the axially moving, non-orbiting scroll member 14.

This connecting tubing 40 is secured at 42 and 44 in a rigid connection. This rigid connection may sometimes be unreliable, and can sometimes become disconnected with movement of the non-orbiting scroll. Moreover, the flexible connector tube is somewhat complex and expensive. Thus, it would be desirable to improve upon this arrangement.

Figure 2A:
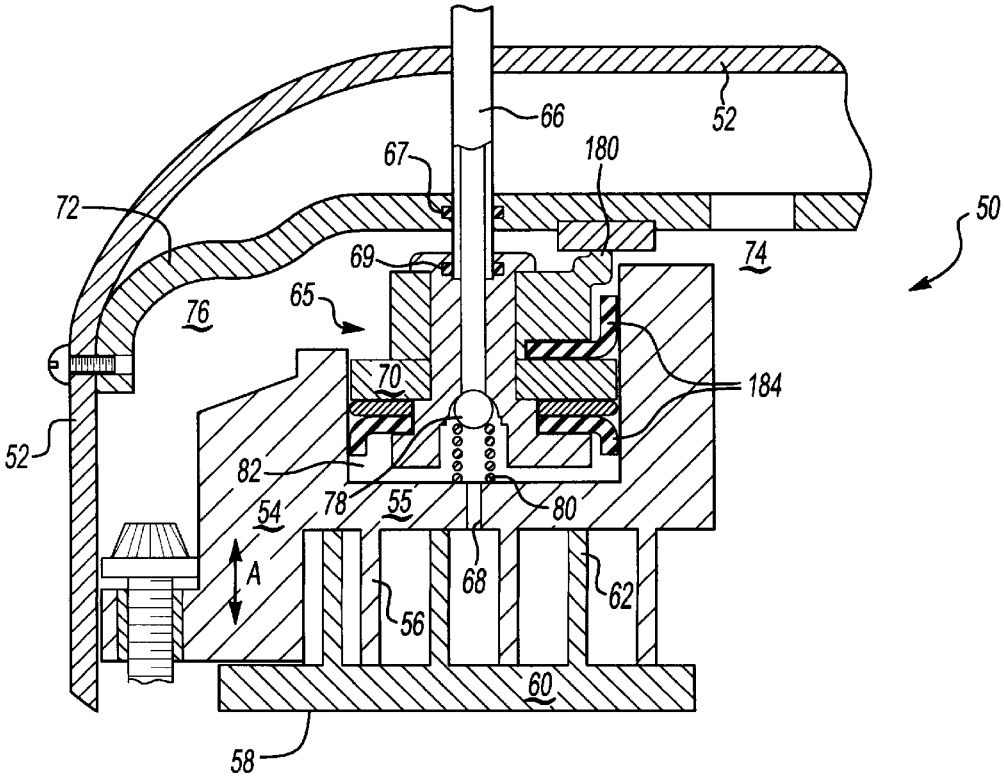
FIG. 2A is a schematic view of a first embodiment connecting system.

A first inventive embodiment shown in FIG. 2A. A portion of a scroll compressor is shown generally at 50. A non-orbiting scroll member 54 is received within scroll shell 52. Non-orbiting scroll member 54 is of the type that may move through a limited axial distance as indicated by arrow A on the figure. Non-orbiting scroll member 54 has a base 55 and wrap 56. An orbiting scroll member 58 has a base 60 and wrap 62 which interfits with wrap 56 to define compression chambers.

Figure 2B:
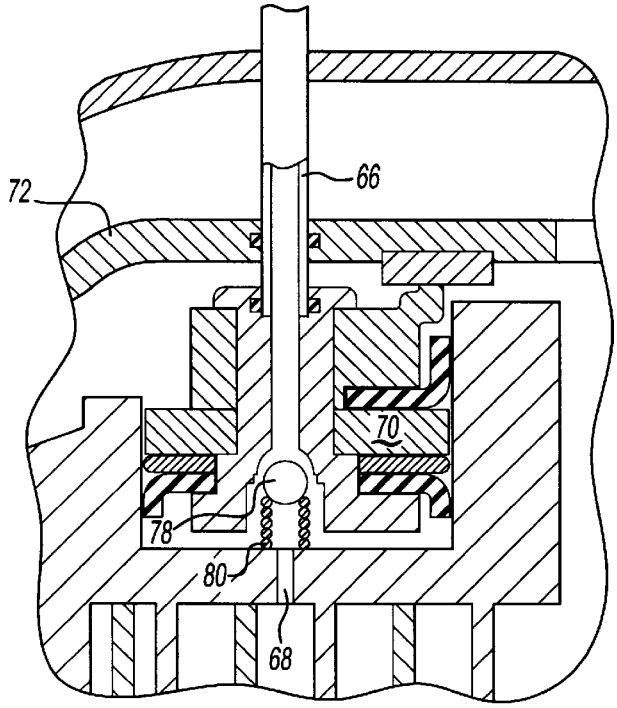
FIG. 2B shows a detail of the FIG. 2A structure.

As shown schematically on FIG. 2A, seal structure 65 is positioned on the base 55 of non-orbiting scroll member 54. In this embodiment, outside economizer tube 66 feeds refrigerant fluid in through floating seal structure 65 to a port 68 on the base 55 of non-orbiting scroll member 54. As can be appreciated, seals 67 and 69 seal the connection between the tube 66 and the separator plate and seal, respectively. As can be seen in FIGS. 2A and 2B, the seal 65 incorporates a central web 70. Such seals are known in scroll compressors having an axially floating non-orbiting scroll. As known, the seal typically seals at 180, 182, 184 between the base 55 of the non-orbiting scroll, and a separator plate 72. More recently, the assignee of the present invention has developed scroll compressors wherein the seal seals between an upper cap, or shell 52 and the base of the non-orbiting scroll. It should be understood that a seal location similar to that type of scroll would also benefit from this invention.

In the present invention, the seal 65 provides a seal point between a discharge pressure chamber 74 and a suction chamber 76. While only one portion of the seal 65 is shown, a worker in this art would recognize that the seal would extend around the entire circumference of the compressor 50. The seal is generally cylindrical, as known. However, the tube 66 and the valve 78 are preferably only at one position. That is, on the opposed side of FIG. 2, the seal would have a cross section that is more in keeping with the known seal. Again, this is as known in the prior art. The inventive aspect of this seal is that a valve 78 is seated within the web 70, and biased by a spring 80 to a closed position. A chamber 82 is defined between the port 68 and the seated valve 78. The chamber 82 would extend around the circumference of the seal 65. This chamber 82 provides the back pressure force, holding the non-orbiting scroll 54 toward the orbiting scroll 58. Thus, when the economizer fluid is not being injected, the valve 78 is held closed by the spring 80. The injection of economizer fluid is intermittent, and thus under a good deal of the operational cycle of the compressor 50, the valve 78 may remain closed.

When fluid is being injected through the tube 68, this pressure will cause the valve 78 to move away from the seat in the web 70 and against the force of the spring 80 as shown in FIG. 2B. The fluid can then be injected into the port 68, and between the compression chambers. As is known, as a non-orbiting scroll 54 moves, the seal 65 flexes, or expands and is compressed, to accommodate the movement. Thus, the desired flow of economizer refrigerant is directed to the non-orbiting scroll member, while at the same time the non-orbiting scroll member is permitted axial movement.

As shown, the non-orbiting scroll 54 can move relative to the tube 66, and thus there is little likelihood that the connection will become disconnected with movement. Moreover, the connection is relatively simple when compared to the prior art.

Figure 3:
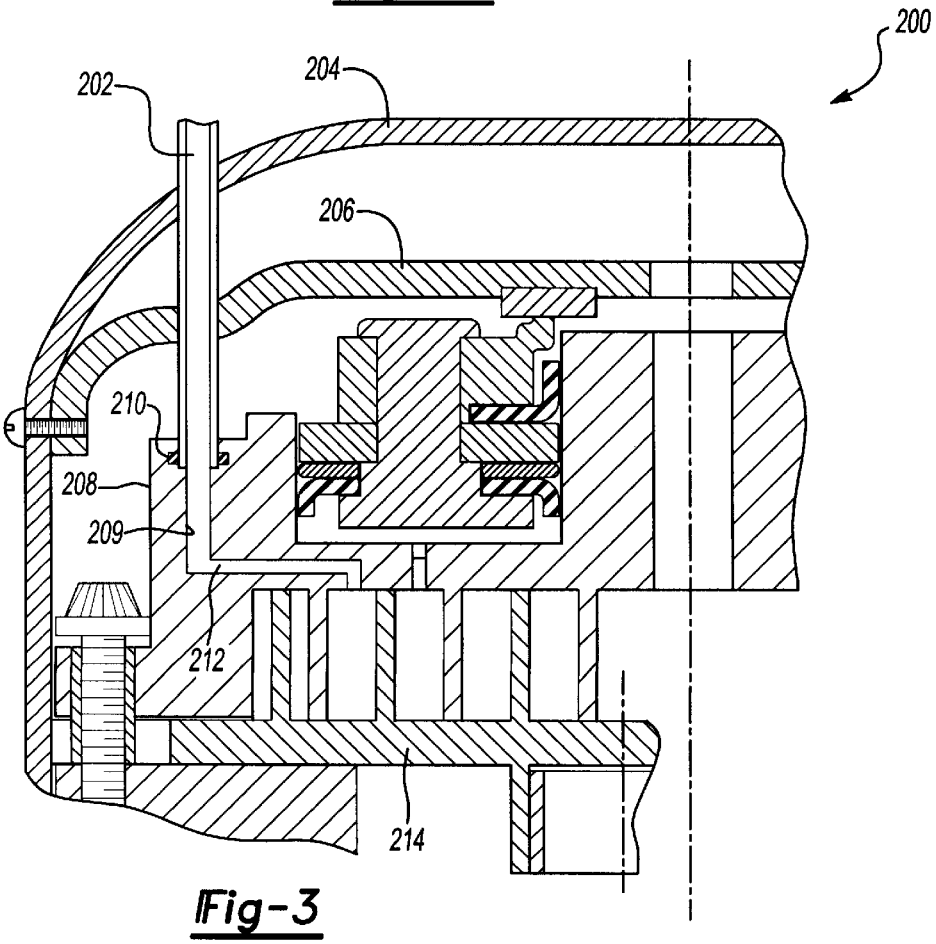
FIG. 3 shows a second embodiment.

FIG. 3 shows another embodiment 200, wherein a tube 202 extends through an outer housing 204, a separator plate 206, and into the non-orbiting scroll 208. As can be appreciated, the contact surface between the opening 209 in the non-orbiting scroll 208 and the tube 202 is sealed by a seal 210. A passage 212 extends into compression chambers defined between the non-orbiting scroll 208 and an orbiting scroll 214. Again, with movement of the non-orbiting scroll 208, the non-orbiting scroll can move relative to the tube 202. However, a seal is still provided.

Figure 4:
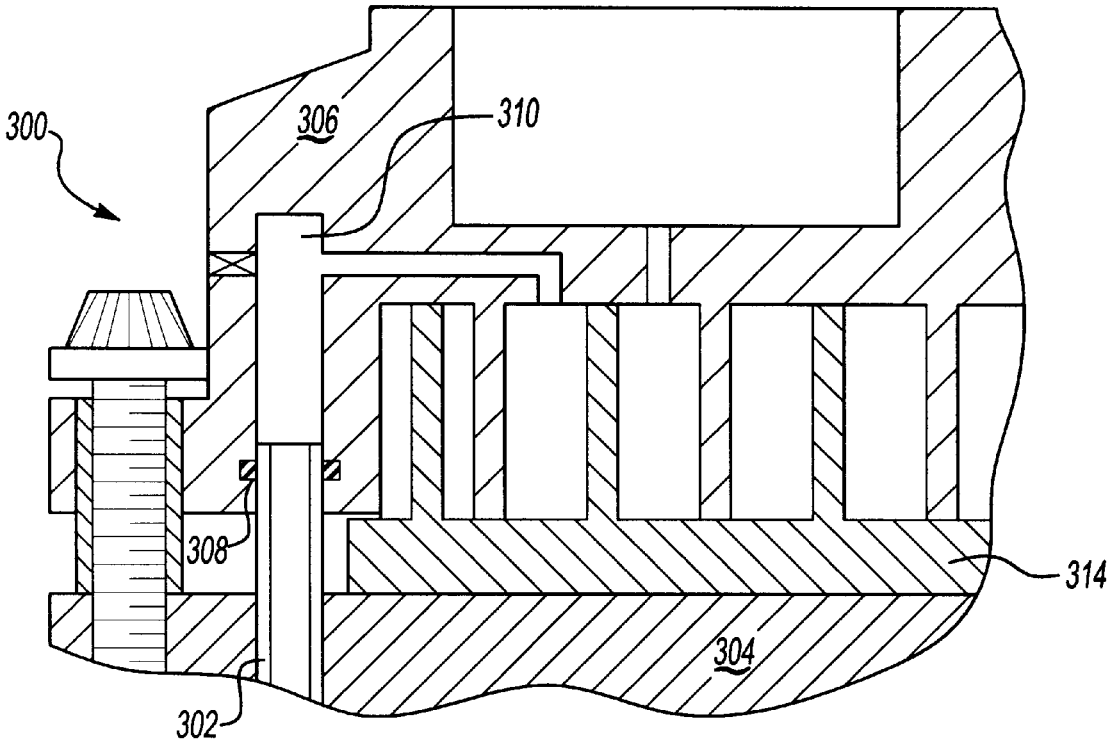
FIG. 4 shows a third embodiment.

Another embodiment 300 is illustrated in FIG. 4. In embodiment 300, the tube 302 extends upwardly through a crankcase 304, and into the non-orbiting scroll 306. Again, a seal 308 seals the connection. A passage 310 leads into the compression chamber defined between the non-orbiting scroll 306 and an orbiting scroll 314. With this embodiment also, the non-orbiting scroll 306 is able to move relative to the tube 302.

With any of the three embodiments disclosed in this application, the non-orbiting scroll is able to move relative to the tube which communicates the economizer fluid. In this way, it is unlikely that the connection will break during movement. Moreover, the connections are relatively simple when compared to the prior art.

A preferred embodiment of this invention has been disclosed, however, a worker in this art would recognize that certain modifications would come within the scope of this invention. For that reason, the following claims should be studied to determine the true scope and content of this invention.

What is claimed is:

1. A scroll compressor comprising:

a non-orbiting scroll member having a base and a generally spiral wrap extending from said base;

an orbiting scroll member having a base and a generally spiral wrap extending from said base;

said non-orbiting scroll member being axially moveable;

said orbiting scroll member being operable to orbit relative to said first scroll member;

a compressor shell that houses said first and second scroll members;

an economizer tube for injecting refrigerant into the scroll compressor; and said economizer tube being relatively rigid and connected to a passage through said non-orbiting scroll member, said connection of said tube to said non-orbiting scroll member allowing said non-orbiting scroll member to move relative to said tube.

2. A scroll compressor as recited in claim 1, wherein said economizer tube injects fluid through said base of said non-orbiting scroll.

3. A scroll compressor as recited in claim 1, wherein the connection of said economizer tube to said non-orbiting scroll includes a tube that connects said economizer injection port to said non-orbiting scroll.

4. A scroll compressor as recited in claim 2, wherein said tube is inserted within an opening in said non-orbiting scroll, and a seal is received in said non-orbiting scroll and contacts an outer peripheral surface of said tube.

5. A scroll compressor as recited in claim 1, wherein the connection of said economizer tube to said non-orbiting scroll member includes a floating seal structure positioned on said base of said non-orbiting scroll member.

6. A scroll compressor as recited in claim 5, wherein the economizer tube injects refrigerant through said floating seal structure to a port in said base of said non-orbiting scroll member.

7. A scroll compressor as recited in claim 6, wherein said floating seal structure communicates with a tap through said base of said non-orbiting scroll to tap a compressed fluid to a back pressure chamber, said back pressure chamber tending to bias said non-orbiting scroll toward said orbiting scroll.

8. A scroll compressor as recited in claim 7, wherein said floating seal structure includes a check valve, said valve blocking refrigerant from said back pressure chamber from passing toward said economizer tube, but allowing flow of refrigerant from said economizer tube into said back pressure chamber.

9. A scroll compressor as recited in claim 1, wherein said tube extends through said housing and into an upper surface of said base of said non-orbiting scroll.

10. A scroll compressor as recited in claim 1, wherein said tube extends upwardly through a crankcase which mounts said orbiting scroll, and extends into an opening in said base of said non-orbiting scroll.

11. A scroll compressor comprising:

a non-orbiting scroll member having a base and a generally spiral wrap extending from said base;

an orbiting scroll member having a base and a generally spiral wrap extending from said base;

said non-orbiting scroll member being axially moveable;

said orbiting scroll member being operable to orbit relative to said first scroll member;

a compressor shell that houses said first and second scroll members;

an economizer tube for injecting refrigerant fluid into the scroll compressor;

an economizer injection port positioned in said compressor shell for receiving refrigerant fluid from said economizer tube;

a fixed inlet port positioned on said base of said non-orbiting scroll member; and a tube rigidly connected into said compressor shell, and said tube being received within an opening and said non-orbiting scroll, said tube being moveable relative to said non-orbiting scroll.

12. A scroll compressor as recited in claim 11, wherein a seal is disposed in an opening in said non-orbiting scroll which receives said tube, said seal contacting an outer peripheral surface of said tube.

13. A scroll compressor comprising:

a non-orbiting scroll member having a base and a generally spiral wrap extending from said base;

an orbiting scroll member having a base and as generally spiral wrap extending from said base;

said non-orbiting scroll member being axially moveable;

said orbiting scroll member being operable to orbit relative to said first scroll member;

a compressor shell that houses said first and second scroll members;

an economizer tube for injecting refrigerant fluid into the scroll compressor; and a floating seal structure positioned on the base of said non-orbiting scroll member wherein said economizer tube injects refrigerant through said floating seal structure to a port in said base of said non-orbiting scroll member so that refrigerant fluid may be injected through said base of said first non-orbiting scroll member while at the same time permitting axial movement of said first non-orbiting scroll member.

14. A scroll compressor as recited in claim 13, wherein said floating seal structure communicates with a tap through said base of said non-orbiting scroll to tap a compressed fluid to a back pressure chamber, said back pressure chamber tending to bias said non-orbiting scroll toward said orbiting scroll.

15. A scroll compressor as recited in claim 14, wherein said floating seal structure includes a check valve, said valve blocking refrigerant from said back pressure chamber from passing toward said economizer tube, but allowing flow of refrigerant from said economizer tube into said back pressure chamber.

16. A scroll compressor as recited in claim 13, wherein said floating seal seals on said base of said non-orbiting scroll at one end, and on a separator plate positioned inwardly from said shell at a second end.

* * * * *